United States Patent [19]

Okuda

[11] Patent Number: 4,976,240

[45] Date of Patent: Dec. 11, 1990

[54] ENGINE IGNITION SYSTEM

[75] Inventor: Hiroshi Okuda, Himeji, Japan

[73] Assignee: Mitsubishi Denki Kabushiki Kaisha, Tokyo, Japan

[21] Appl. No.: 423,285

[22] Filed: Oct. 18, 1989

[51] Int. Cl.[5] ..... F02P 5/10

[52] U.S. Cl. ..... 123/406; 123/414; 123/416

[58] Field of Search ..... 123/406, 410, 418, 415, 123/179 B; 364/437.05

[56] References Cited

U.S. PATENT DOCUMENTS

| | | | |
|---|---|---|---|
| 4,499,875 | 2/1985 | Katayama et al. | 123/416 |
| 4,570,594 | 2/1986 | Egami et al. | 132/414 |
| 4,664,082 | 5/1987 | Suzuki | 123/414 |
| 4,732,130 | 3/1988 | Suzuki | 364/431.05 |
| 4,787,355 | 11/1988 | Onaeda | 123/414 |
| 4,827,886 | 5/1989 | Onaeda | 123/414 |
| 4,854,284 | 8/1989 | Hara et al. | 123/414 |
| 4,869,221 | 9/1989 | Abe | 123/414 |

*Primary Examiner*—Raymond A. Neill
*Attorney, Agent, or Firm*—Sughrue, Mion, Zinn, Macpeak & Seas

[57] ABSTRACT

An engine ignition system comprising a signal coil for generating a first reference signal at an advanced angle and a second reference signal at a start position in synchronization with the rotation of an engine, a throttle sensor for detecting a throttle opening degree and a first ignition timing calculation circuit for calculating an ignition timing corresponding to an output signal from the throttle sensor in accordance with the first reference signal when the ignition timing is advanced from a predetermined ignition timing. The ignition timing system further comprises a second ignition timing calculation circuit for calculating an ignition timing corresponding to an output signal from the throttle sensor in accordance with the second reference signal when the ignition timing is retarded from a predetermined ignition timing. Either one of the first and the second ignition timing calculating circuits may comprise a function generator circuit having a calculating function equal to the first and said second ignition timing circuits for changing ignition timing characteristics of the first and the second ignition timing calculation circuits relative to the throttle opening degree into linear characteristics.

2 Claims, 3 Drawing Sheets

ENGINE IGNITION SYSTEM

BACKGROUND OF THE INVENTION

This invention relates to an engine ignition system and more particularly to an engine ignition system for changing the ignition timing of an engine in accordance with a throttle opening degree.

FIG. 1 is a circuit diagram of a conventional engine ignition system. In the figure, reference numeral 1 is a generator coil of a magnet generator driven by an unillustrated engine. One end of the generator coil 1 is connected to an ignition capacitor 3 through a diode 2 and the other end is grounded. 4 is a thyristor for allowing the discharge of the ignition capacitor 3 into an ignition coil 5, 6 and 7 are a primary coil and a secondary coil, respectively, of the ignition coil 5 and the secondary coil 7 is connected to an ignition plug 8. 9 is a diode connected in parallel to the primary coil 6 for bypassing a reverse electromotive force across the ignition coil 5, and 10 is a bias resistor connected between the gate and the cathode electrodes of the thyristor 4.

11 is a power source circuit composed of a series circuit including a diode 12, a resistor 13 and a Zener diode 14 connected across terminals of the generator coil 1 and a capacitor 15 connected in parallel to the Zener diode 14 and having an output terminal at a junction between the resistor 13 and the Zener diode 14.

16 is a signal coil generating an ignition signal in synchronization with the rotation of the engine, one end of which is connected to the gate of the thyristor 4 through a resistor 17 and a diode 18 and grounded through a diode 19 in the opposite direction and a resistor 20, and the other end of which is grounded. 21 is an ignition timing calculation circuit having its input terminal connected at a junction between the diode 19 and the resistor 20. The ignition timing calculation circuit calculates an ignition timing in accordance with an output signal from the signal coil 16 and a signal from a throttle sensor 22 which detects the degree of opening of the throttle, thereby providing an ignition timing control signal to the gate of the thyristor 4. At the junction between the resistor 17 and the diode 18, the collector of a transistor 23 is connected. The base of this transistor 23 is connected to a junction between a resistor 25 connected in series to the power source and a capacitor 26, and the emitter is connected to ground.

The operation will now be described. When the engine is driven by an unillustrated starter or the like, the generator coil 1 generates an output power, which charges the capacitor 3 after it is rectified by the diode 2. The signal coil 16 on the other hand generates the ignition signal in synchronization with the rotation of the engine. A positive wave component or retarded angle side reference signal is directly applied to the gate of the thyristor 4 through the resistor 17 and the diode 18, and the negative wave component or the advanced angle side reference signal is supplied to the ignition timing calculating circuit 21, which calculates an ignition timing corresponding to the throttle opening degree detected by the throttle sensor 22 on the basis of the advanced angle side reference signal. This ignition timing calculation is set to provide a retarded angle when the throttle opening degree is closure side and an advanced angle when the throttle opening degree is open side, providing the ignition timing control signal corresponding to the throttle opening degree to the gate of the thyristor 4. The thyristor 4 is brought into conducting state by the retarded angle side reference signal or the ignition timing control signal to cause the charge on the capacitor 3 to discharge through the primary coil 6 of the ignition coil 5, thereby generating a high voltage at the secondary coil 7 to generate a spark across the spark plug 8.

At the time when the engine is being started, the output voltage from the generating coil 1 is low and the output voltage from the power source circuit 11 does not reach the predetermined level, maintaining the transistor 23 in the nonconducting state, so that the retarded angle side reference signal is directly applied to the gate of the thyristor 4. After a lapse of a predetermined time after starting of the engine, the voltage at the junction between the resistor 25 and the capacitor 26 reaches the predetermined level, causing the transistor 23 to turn on to bypass the retarded angle side reference signal through the transistor 23. That is, during the starting operation of the engine, the ignition operation is achieved by the retarded angle side reference signal, and during the normal operation after starting of the engine, the ignition operation is achieved by the ignition timing control signal which corresponds to the degree of opening of the throttle.

In the conventional engine ignition system constructed as above described, the ignition timing calculating circuit 21 calculates the ignition timing for the next ignition by the advanced angle side reference signal from the signal coil 16. Therefore, at around the throttle position of complete closure, the time between the input of the reference signal and the output of the ignition timing control signal is elongated, so that the ignition timing at low rpms becomes unstable, causing the rotation to be disadvantageously unstable.

SUMMARY OF THE INVENTION

Accordingly, one object of the present invention is to provide an engine ignition system free from the above-discussed problems of the conventional apparatus.

Another object of the present invention is to provide an engine ignition system in which the rotation is stable even at low rotational speeds.

With the above objects in view, the engine ignition system of the present invention comprises a signal coil for generating a first reference signal at an advanced angle and a second reference signal at a start position in synchronization with the rotation of an engine, a throttle sensor for detecting a throttle opening degree and a first ignition timing calculation circuit for calculating an ignition timing corresponding to an output signal from the throttle sensor in accordance with the first reference signal when the ignition timing is advanced from a predetermined ignition timing. The ignition timing system further comprises a second ignition timing calculation circuit for calculating an ignition timing corresponding to an output signal from the throttle sensor in accordance with the second reference signal when the ignition timing is retarded from a predetermined ignition timing.

Either one of the first and the second ignition timing calculating circuits may comprise a function generator circuit having a calculating function equal to the first and second ignition timing circuits for changing ignition timing characteristics of the first and the second ignition timing calculation circuits relative to the throttle opening degree into linear characteristics.

According to the present invention, when the retarded angle is large, the ignition timing calculation is achieved on the basis of the second reference signal, so that the time between the incoming second reference signal and the outgoing ignition timing control signal is short, ensuring an accurate ignition timing even during low rotational speeds of the engine.

Also, in the embodiment provided with a function generator circuit, the ignition timing characteristics linearly vary as the throttle opening degree changes from its fully closed level to the fully open level, so that the variation of the rotational speed of the engine is relative to the change in the throttle opening degree.

BRIEF DESCRIPTION OF THE DRAWINGS

The present invention will become more readily apparent from the following detailed description of the preferred embodiment of the present invention taken in conjunction with the accompanying drawings, in which.

DESCRIPTION OF THE PREFERRED EMBODIMENT

Figure 1:
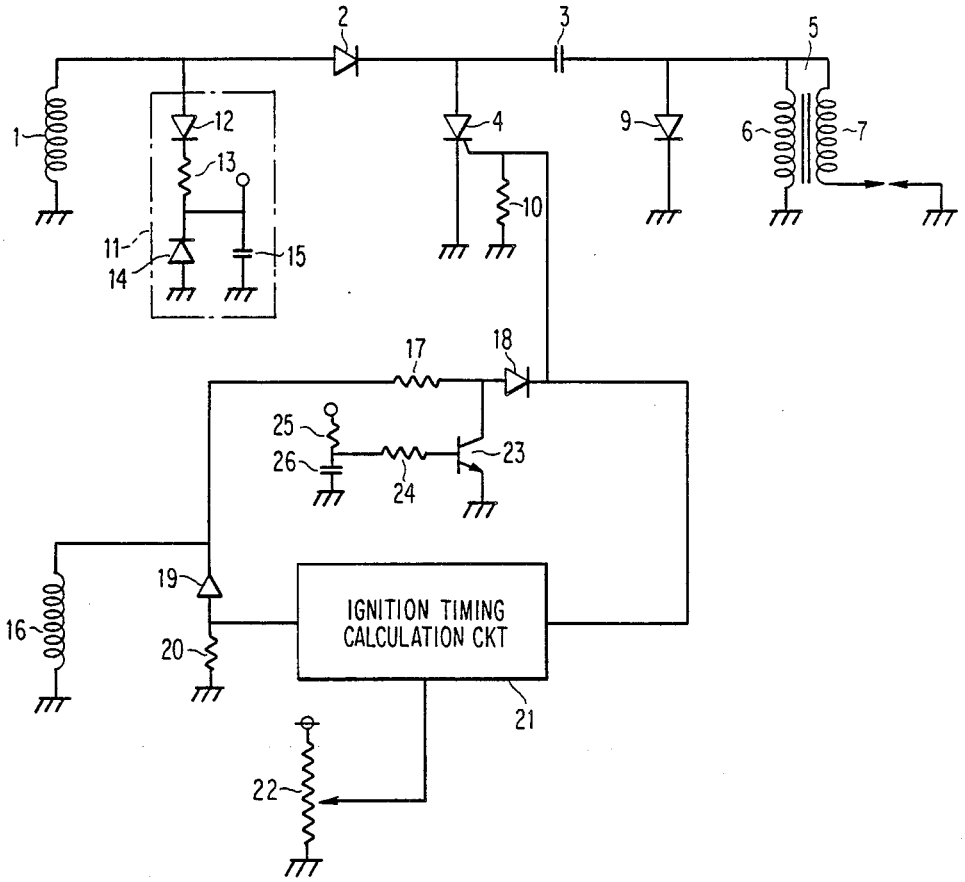
FIG. 1 is a circuit diagram of the conventional engine ignition system.
Figure 2:
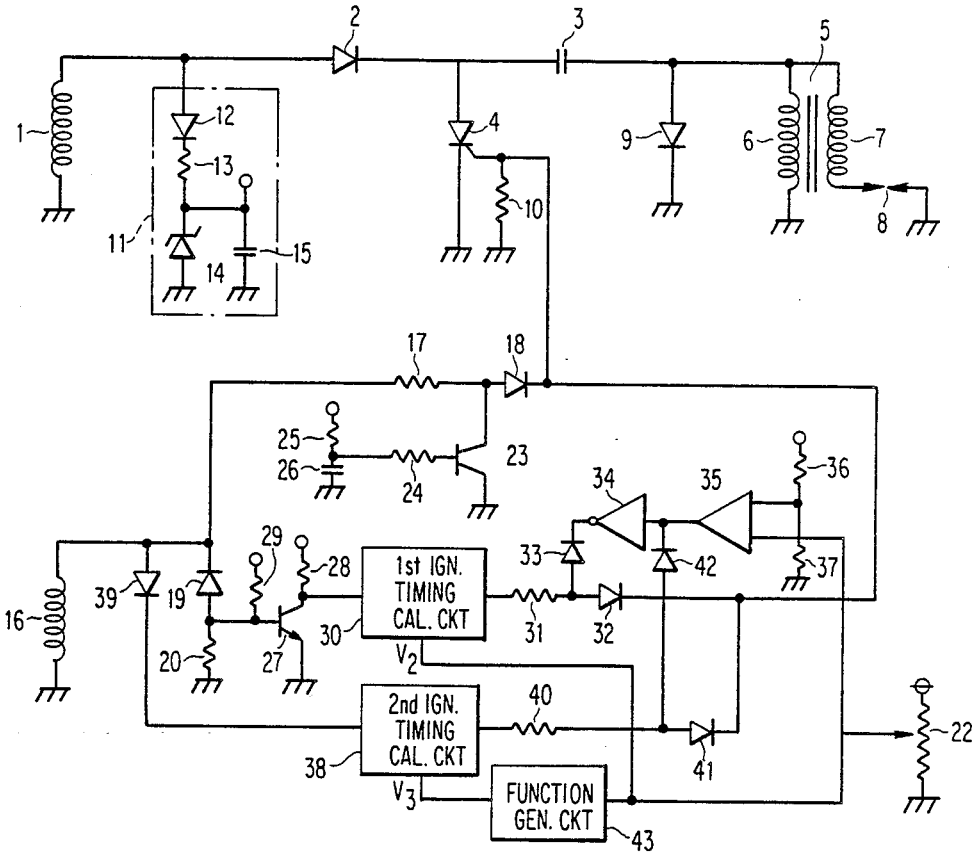
FIG. 2 is a circuit diagram of an embodiment of an engine ignition system of the present invention.

FIG. 2 is a circuit diagram of an engine ignition system of one embodiment of the present invention. In the figure, the reference numerals 1 to 26 are similar to those in the conventional ignition timing control system, so that the same reference numerals will be assigned to corresponding components and their explanation will be omitted. The reference numeral 27 is a transistor connected at its base to a junction between the diode 19 and the resistor 20, the collector and the base being connected to the power source through resistors 28 and 29, respectively, and the collector being connected to the input of a first ignition timing calculation circuit 30 and its emitter being connected to ground. An output terminal of the first ignition timing calculation circuit 30 is connected to the gate of the thyristor 4 through a resistor 31 and a diode 32. Also, a junction between the resistor 31 and the diode 32 is connected to an output terminal of an inverter 34 through a diode 33, and an input terminal of the inverter 34 is connected to an output terminal of a comparator 35. An inversion input terminal of the comparator 35 is connected to a junction between voltage-dividing resistors 36 and 37 connected to the power source, and a non-inversion input terminal is connected to an output terminal of the throttle sensor 22. The system also comprises a second ignition timing calculation circuit 38 having a calculation function similar to that of the first ignition timing calculation circuit 30. An input terminal of the second ignition timing calculation circuit 38 is connected to one end of the signal coil 16 through a diode 39, and an output terminal of the second ignition timing calculation circuit 38 is connected to the gate of the thyristor 4 through a resistor 40 and a diode 41, a junction of which is connected to the input terminal of the inverter 34 through a diode 42. Also, a throttle sensor signal input terminal of the first ignition timing calculation circuit 30 is directly connected to the throttle sensor 22, and a throttle sensor signal input terminal of the second ignition timing calculation circuit 38 is connected to the throttle sensor 22 through a function generator circuit 43.

Figure 3:
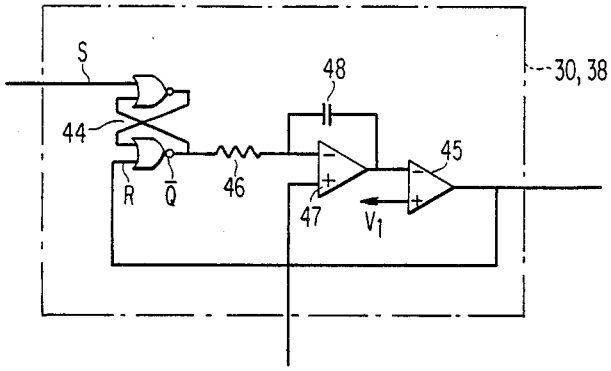
FIG. 3 is a circuit diagram of the first and the second ignition timing calculation circuits of the engine ignition system of the present invention.

FIG. 3 is a circuit diagram illustrating the construction of the first and the second ignition timing calculation circuits 30 and 38. In the figure, a flip-flop 44 composed of a pair of NOR circuits has a set terminal S which serves as an input terminal of the first and the second ignition timing calculation circuits 30 and 38, a reset terminal R connected to an output terminal of a comparator 45, and a $\overline{Q}$ output terminal connected to an inversion input terminal of an operating amplifier 47 through a resistor 46. A capacitor 48 is connected between the inversion input terminal and the output terminal of the operating amplifier 47, and a non-inversion input terminal serves as a throttle sensor signal input terminal of the first and the second ignition timing calculation circuits 30 and 38. Further, the comparator 45 has a non-inversion input terminal to which a reference voltage $V_1$ is applied and an output terminal which serves as the output terminal of the first and the second ignition timing control calculation circuits 30 and 38.

Figure 4:
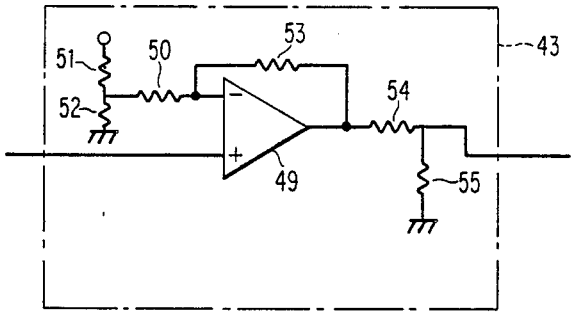
FIG. 4 is a circuit diagram of the function generator circuit of the engine ignition system of the present invention.

FIG. 4 is a circuit diagram of the function generator circuit 43, which comprises an operational amplifier 49 whose inversion input terminal is connected, through a resistor 50, to a junction between voltage-dividing resistors 51 and 52 connected to the power source, and whose non-inversion input terminal is connected to the output terminal of the throttle sensor 22. Also, a resistor 53 is connected between the inversion input terminal and the output terminal of the operational amplifier 49, and the output terminal is connected to the non-inversion input terminal of the operational amplifier 47 of the second ignition timing calculating circuit 38 through a resistor 54, and a junction between the resistor 54 and the non-inversion input terminal of the operatinal amplifier 47 is grounded through a resistor 55.

Figure 5:
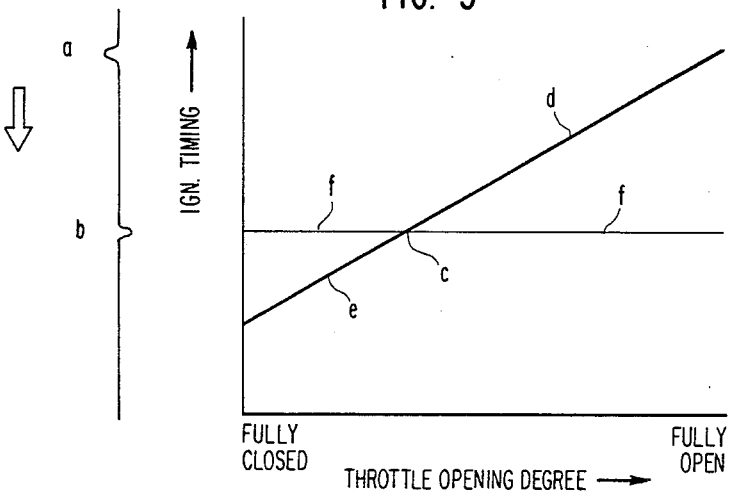
FIG. 5 is a graph showing the ignition timing characteristics of the engine ignition system of the present invention relative to the throttle opening degree.

The operation of the above ignition timing control system will now be described. Upon rotation of the engine, the signal coil 16 generates a first reference signal a on the advanced angle side and a second reference signal b at the start position as shown in FIG. 5. In FIG. 5, a thick downward arrow on the left designates the direction of rotation of the engine. The first reference signal a is supplied to the first ignition timing calculation circuit 30 through the resistor 20 and the transistor 27, and the second reference signal b is supplied to the second ignition timing calculation circuit 38 through the diode 39.

When the first reference signal a is generated, the transistor 27 is turned off and the flip-flop 44 of the first ignition timing calculation circuit 30 is set, causing a discharge current from the capacitor 48 to start flowing through a current path composed of the $\overline{Q}$ output terminal of the flip-flop 44→ the resistor 46→ the capacitor 48→ the output terminal of the operational amplifier 47. When the output voltage from the operational amplifier 47 becomes lower than the reference voltage $V_1$ applied to the non-inversion input terminal of the comparator 45, a signal of "0"→"1" appears at the output terminal of the comparator 45. Also, at this time, the flip-flop is reset and the $\overline{Q}$ output terminal is inverted from "1"→"0" to interrupt the discharge current from the capacitor 48, and at the same time a charging current to the capacitor 48 starts flowing through the output terminal of the operational amplifier 47→ the capacitor 48→ the resistor 46→ the $\overline{Q}$ output terminal of the flip-flop 44. At this time, since the output voltage from the operational amplifier 47 becomes higher than the above reference voltage again due to the above charging current, the output from the comparator 45 which has changed into "1" in the above changes again into "0". This charging current is maintained until the first ignition timing calculation circuit 30 is supplied with the next ignition signal.

The engine rotational angle $\theta$ through which the engine rotates between the input of the ignition signal into the first ignition timing calculation circuit 30 and the output of the ignition timing control signal therefrom can be expressed as a linear function of a voltage $V_2$ from the throttle sensor signal input terminal. That is, as the output voltage from the throttle sensor 22 increases (the throttle opening degree is on the closure side), the ignition timing control signal shifts to the retarded angle side, and as the output voltage from the throttle sensor 22 decreases, the proportionally advanced ignition timing control signal is provided. This is dipicted by a straight line d on the fully open side relative to a point c of FIG. 5.

The second ignition timing calculating circuit 38 also achieves the same operation as that of the first ignition timing calculating circuit 30 by providing an ignition signal supplied from the signal coil 16 except that the throttle sensor signal input terminal voltage $V_3$ is the output voltage from the function generator circuit 43.

The resistors 50–53 of the function generator circuit 43 are set to have such values that the output voltage therefrom is held at OV until the output voltage from the throttle sensor 22 applied to the non-inversion input terminal of the operational amplifier 49 reaches a predetermined level, and the ignition timing of the second ignition timing calculating circuit 38 corresponding to the above predetermined level corresponds to a point c in FIG. 5. The output voltage from the operational amplifier 49 which varies in proportion to the output voltage from the throttle sensor 22 is divided by the resistors 54 and 55, and the ignition timing control signal from the second ignition timing calculating circuit 38 corresponding to the ratio of the above variation has an ignition timing characteristic as shown by a straight line e.

When the output voltage from the throttle sensor 22 exceeds the voltage at the inversion input terminal divided by the resistors 36 and 37 or when the throttle opening degree is on the closure side relative to the predetermined value, the output from the comparator 35 is at a high level and the output from the inverter 34 is at a low level since the output voltage from the throttle sensor 22 is applied to the non-inversion input terminal of the comparator 35, and the ignition timing control signal from the first ignition timing calculation circuit 30 is absorbed and the ignition timing control signal supplied from the second ignition timing calculating circuit 38 is applied to the gate of the thyristor 4. When the output voltage from the throttle sensor 22 is equal to or less than the inversion input terminal voltage from the comparator 35 or when the throttle opening degree is on the open side, the output terminal of the comparator 35 is at a low level and the output terminal of the inverter 34 is at a high level, so that the output from the first ignition timing calculating circuit 30 is selected and applied to the gate of the thyristor 4. Therefore, when the throttle opening degree is on the closure side relative to the position corresponding to the point c, the ignition operation is achieved by the second ignition timing calculating circuit 38 having the ignition timing characteristic shown by the line e, and when the throttle opening degree is on the open side relative to the point c, the ignition operation is achieved by the first ignition timing calculating circuit 30 having an ignition timing characteristic shown by the line d.

During the starting operation of the engine, as is similar to the operation of the conventional system, the second reference signal from the signal coil 16 having the ignition timing characteristic shown by a line f in FIG. 5 is directly applied to the gate of the thyristor 4 and the ignition operation is achieved independently of the ignition timing proportional to the throttle opening degree.

Other operating modes of the ignition operation are similar to those of the conventional ignition system, so that their descriptions will be omitted.

As has been described, according to the present invention, since the arrangement is such that the ignition timing calculation is achieved through the use of the second reference signal when the retarded angle is large, the time between the input of the ignition signal and the output of the ignition timing control signal is short and accordingly an accurate ignition timing calculation can be achieved even at a low rotational speed, resulting in a stable low speed rotation of the engine.

Also, with the system including the function generator circuit, the change in the engine rotational speed in accordance with the throttle opening degree is smooth.

What is claimed is:

1. An engine ignition system comprising:

a signal coil for generating a first reference signal at an advanced angle and a second reference signal at a start position in synchronization with the rotation of an engine;

a throttle sensor for detecting a throttle opening degree;

a first ignition timing calculation circuit for calculating an ignition timing corresponding to an output signal from said throttle sensor in accordance with said first reference signal when the ignition timing is advanced from a predetermined ignition timing; and a second ignition timing calculation circuit for calculating an ignition timing corresponding to an output signal from said throttle sensor in accordance with said second reference signal when the ignition timing is retarded from a predetermined ignition timing.

2. An engine ignition system as claimed in claim 1, wherein one of said first and said second ignition timing calculating circuits comprises a function generator circuit having a calculating function equal to said first and said second ignition timing circuits for changing ignition timing characteristics of said first and said second ignition timing calculation circuits relative to the throttle opening degree into linear characteristics.

* * * * *